US005617758A

United States Patent [19]

Nishida et al.

[11] Patent Number: 5,617,758

[45] Date of Patent: Apr. 8, 1997

[54] PERMANENT MAGNET STARTER

[75] Inventors: Tatsumi Nishida, Mito; Koki Ueta; Yasuhiko Maruhashi, both of Hitachinaka, all of Japan

[73] Assignee: Hitachi, Ltd., Japan

[21] Appl. No.: 579,212

[22] Filed: Dec. 28, 1995

[30] Foreign Application Priority Data

Dec. 28, 1994 [JP] Japan ..... 6-326636

[51] Int. Cl.[6] ..... F02N 15/06

[52] U.S. Cl. ..... 74/7 B; 74/6; 477/13; 290/48; 192/42

[58] Field of Search ..... 477/12, 13, 8; 74/6, 7 R, 7 A, 7 B, 7 C, 7 D, 7 E; 290/38 R, 48, 38 C; 192/42, 17 C, 12 B

[56] References Cited

U.S. PATENT DOCUMENTS

| | | | |
|---|---|---|---|
| 2,548,268 | 4/1951 | Metsger | 477/8 X |
| 2,578,094 | 12/1951 | Sears | 477/13 X |
| 4,507,565 | 3/1985 | Hamano | 290/48 X |
| 4,744,258 | 5/1988 | Volino | 192/42 X |
| 4,755,688 | 7/1988 | Isozumi | 290/48 X |
| 4,768,392 | 9/1988 | Giometti | 74/7 A X |
| 5,023,466 | 1/1991 | Isozumi | 74/7 C X |
| 5,044,212 | 9/1991 | Isozumi et al. | 290/48 X |
| 5,052,235 | 10/1991 | Isozumi | 74/6 X |
| 5,231,307 | 7/1993 | Yumiyama et al. | 74/6 X |
| 5,241,871 | 9/1993 | McKnight et al. | 74/7 R X |
| 5,277,075 | 1/1994 | Sakamoto et al. | 74/7 R |

FOREIGN PATENT DOCUMENTS 57-168057 10/1982 Japan .

*Primary Examiner*—Charles A. Marmor
*Assistant Examiner*—Peter Kwon
*Attorney, Agent, or Firm*—Evenson, McKeown, Edwards & Lenahan, P.L.L.C.

[57] ABSTRACT

In a permanent magnet starter, a pinion clutch is smoothly engaged with a rotating shaft of an electric motor through a helical spline. A rotation restraint member is arranged at an outer periphery portion and this rotation restraint member is forcibly arranged by a magnetic field coil which is controlled from an outside portion. In a permanent magnet type motor having no magnetic field coil for exciting the motor, it is unnecessary to alter a motor unit. By the rotation force of an armature a pinion gear of the pinion clutch is moved, accordingly the permanent magnet starter for reducing the collision force during the meshing time of the pinion gear to a ring gear can be obtained. Further the permanent magnet starter having a superior gear meshing withstanding property and further without the lowering in the sealing property in the motor unit can be obtained.

7 Claims, 3 Drawing Sheets

PERMANENT MAGNET STARTER

BACKGROUND OF THE INVENTION

The present invention relates to a permanent magnet starter, and particularly to a permanent magnet magnetic field type starter suitable for use in an automobile.

In a conventional starter, it has known during the starting of an engine when the collision force is reduced when a pinion gear of the starter meshes into a ring gear, for example as shown in Japanese patent laid-open No. Sho 57-168,057.

In this kind of the conventional starter, a pole core is moved toward the radial direction using the magnetic field which is generated by a magnetic field coil of a motor, and the rotation of a pinion clutch is restrained by such a force.

By effectively exhibiting the thrust force of the pinion clutch according to a helical spline, the pinon gear is meshed into the ring gear. After that, the return of the pinion gear due to the reaction force of the engine after the dash out of the pinion gear is prevented in accordance with a push rod which is positioned at a rear end of a clutch unit.

However, in the above stated conventional starter technique, since the magnetic field generated by the magnetic field coil of the motor is used as the rotation force of the pinion clutch, it is effective to a wound magnetic field type permanent magnet starter, however it can not apply in a field of a permanent magnet magnetic field type permanent magnet starter which has no magnetic field coil for exciting the motor.

Further, in the conventional starter techniques, since the pole core moves toward the radial direction, it is difficult to obtain a good shielding property surrounding the moving pole core. Further, taking into the consideration about the surrounding apparatuses it is necessary to arrange the components of the starter, thereby it presents a low service property.

SUMMARY OF THE INVENTION

An object of the present invention is provide a permanent magnet starter wherein without lowering the sealing property of a motor unit a permanent magnet starter structure having a superior gear meshing withstanding property between a pinion gear and a ring gear and a simplified structure can be obtained.

Another object of the present invention is to provide a permanent magnet starter wherein an electric circuit construction for constituting a circuit of the permanent magnet starter can be simplified and the rotation restraint force of a pinion clutch can be surely obtained.

The above stated objects of the present invention is attained by a permanent magnet starter for starting an engine in which the rotating force of a permanent magnet magnetic field type electric motor is transmitted a ring gear of the engine through a pinion clutch and a pinion gear provided on the pinion clutch.

In the above permanent magnet starter, the pinion clutch is smoothly engaged with a rotating shaft of the electric motor through a helical spline, and a rotation restraint member is arranged at an outer periphery portion of the pinion clutch and the rotation restraint member is forcibly arranged through a magnet field coil which is controlled by an outside portion.

Further the above stated objects of the present invention is attained by a permanent magnet starter for starting an engine in which the rotating force of a permanent magnet magnetic field type electric motor is transmitted a ring gear of the engine through a pinion clutch and a pinion gear provided on the pinion clutch.

In the above permanent magnet starter, the pinion clutch is smoothly engaged with a rotating shaft of the electric motor through a helical spline, a rotation restraint member is arranged at an outer periphery portion and the rotation restraint member is forcibly arranged through by a magnet field coil which is controlled by an outside portion, and the permanent magnet starter comprises further a switching means, and when the rotation prevention function by the rotation restraint member works, by operating together the rotation restraint member the switching means forms a driving circuit of the electric motor.

The rotation restraint member is formed at the outer periphery portion of the pinion clutch, and this rotation restraint member presses under pressure the maximum outer periphery portion of the pinion clutch and restrains the rotation of the pinion clutch in accordance with the magnetic force generated by supplying the electricity to the magnetic field coil.

Further, a part of the power supply supplied to the magnetic field coil flows into the armature and gives the moderately initial rotation to the armature. This current is extremely small because the motor does not reach to attain the full rotation condition. By the function of the helical spline the pinion clutch moderately moves toward the ring gear and then the pinion gear meshes into the ring gear.

When the pinion gear meshes into the ring gear, the rotation restraint member made of the ferromagnetic member is released from the contacting condition with the maximum outer periphery of the pinion clutch and this pinion gear further moves toward the central direction of a motor unit.

The main contact (the switching means) is provided on the reverse end portion against the moving direction of the rotation restraint member made of the ferromagnetic member and this main contact closes then the motor fully rotates and the engine starts.

DESCRIPTION OF THE INVENTION

Hereinafter, one embodiment of a permanent magnet starter according to the present invention will be explained referring to drawings.

Figure 1:
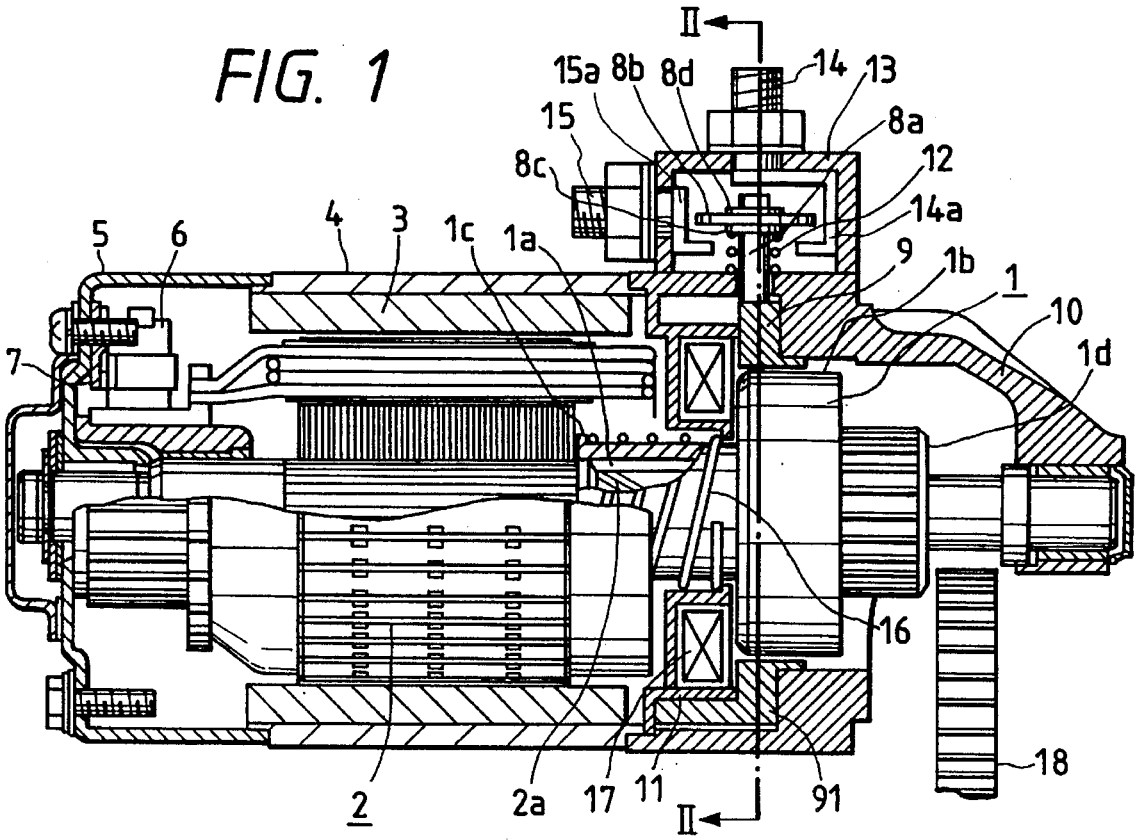
FIG. 1 is a partially cross-sectional view of one embodiment of a permanent magnet starter according to the present invention, in which a pinion gear is not meshed into a ring gear.
Figure 2:
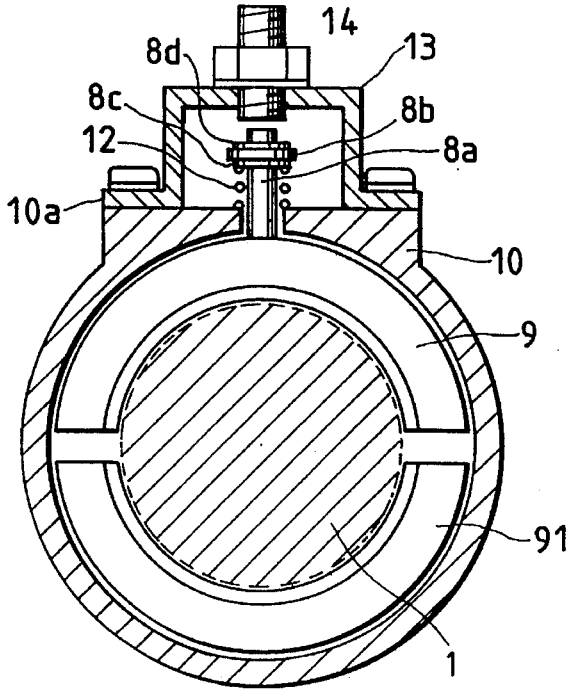
FIG. 2 is a cross-sectional view taken from a line II—II of FIG. 1.

FIG. 1 is a partially cross-sectional view of one embodiment of a permanent magnet starter according to the present invention and FIG. 2 is a cross-sectional view taken from a line II—II of FIG. 1.

A pinion clutch 1 for constituting one-direction overran clutch is movably engaged toward the axial direction with a rotating shaft of an armature 2 through a helical spline 2*a* and a helical spline 1*a* of a clutch outer of the pinion clutch 1.

Further, a motor unit is formed at an outer periphery portion of the armature 2. This motor unit comprises the armature 2, a magnetic field permanent magnet 3 which is arranged with a rotating clearance, a cylindrical form yoke 4 for fixing the permanent magnet 3, a rear bracket 5 for supporting the shaft of the armature 2, and a brush holder 7 in which a brush member 6 is arranged and supplies the electricity to the armature 2.

Besides, a pair of rotation restraint members 9 and 91 are arranged at an outer side of the maximum outer periphery portion of the pinion clutch 1. The rotation restraint members 9 and 91 have a clearance with the maximum outer periphery portion 1*b* and are made of a ferromagnetic material member.

Each of the rotation restraint members 9 and 91 is respectively formed with a semi-circular shape and is arranged to have the concentric position against the pinion clutch 1. The rotation restraint members 9 and 91 are arranged by sandwiching to the axial direction a gear case 10 and an intermediate bracket 11 which is fixedly arranged between the gear case 10 and the yoke 4.

The rotation restraint members 9 and 91 are overlapped at the maximum outer periphery portion 1*b* of the pinion clutch 1 toward the axial direction to have a length part which is less than a move dimension of the pinion clutch 1.

Herein, a movable pin 8*a* is provided at the outer periphery portion of the rotation restraint member 9. This movable pin 8*a* is vertically provided to the axial direction through a mechanical connection such as the welding and the elastic connection. Further, the movable pin 8*a* is provided by penetrating the above stated gear case 10.

Further, another movable contact 8*b* is fixed to an end portion of the movable pin 8*a* through insulating plate members 8*c* and 8*d* and maintains the insulation with the above stated movable pin 8*a*. However, when the movable pin 8*a* is made of the insulating material member, it is unnecessary to provide the above stated insulating plate members 8*c* and 8*d*.

A contact returning spring member 12 is arranged between the above stated insulating plate member 8*c* and the gear case 10. This contact returning spring member 12 forms a coil spring member under the compressive arrangement.

At a normal time or no operating time of the starter, the contact returning spring member 12 works to make a clearance between the pinion clutch 1 and the rotation restraint member 9.

Further, a case 13 is formed by an insulating material member at an upper flat face 10*a* of the above stated gear case 10 and this case 13 is fixed by fastening through avis.

Two fixing contacts 14 and 15 are fixedly arranged to the case 13 by shifting 90° lengthwise and breadthwise, in other words the fixing contact 14 is vertically provided and the fixing contact 15 is horizontally provided to have the angle of 90 degree against the fixing contact 14.

The fixing contacts 14 and 15 are arranged by opposing to the movable contact 8*b* and are connected to conductive plate members 14*a* and 15*a*. These conductive plate members 14*a* and 15*a* are arranged at an inner face of the insulating case 13.

The fixing contacts 14 and 15 constitute a main contact 20 in company with the movable contact 8*b* and the main contact 20 forms a switching means for supplying the electricity to the brush member 6 as stated in latter.

In relation to the axial direction move of the pinion clutch 1, a pinion returning spring member 16 is arranged between a collar portion 1*c* of the pinion clutch 1 and the intermediate bracket 11. And at a normal condition a pinion gear 1*d* of the pinion clutch 1 is held not to project. This pinion gear 1*d* is provided on the pinion clutch 1 at an end portion thereof.

The above stated intermediate bracket 11 is made of the ferromagnetic material member and a magnetic circuit is constituted by the rotation restraint members 9 and 91 and the pinion clutch 1.

A cylindrical shape magnetic field coil 17 is arranged on the intermediate bracket 11, and when the magnetic field coil 17 is supplied the electricity, the rotation restraint members 9 and 91 are attracted.

Figure 3:
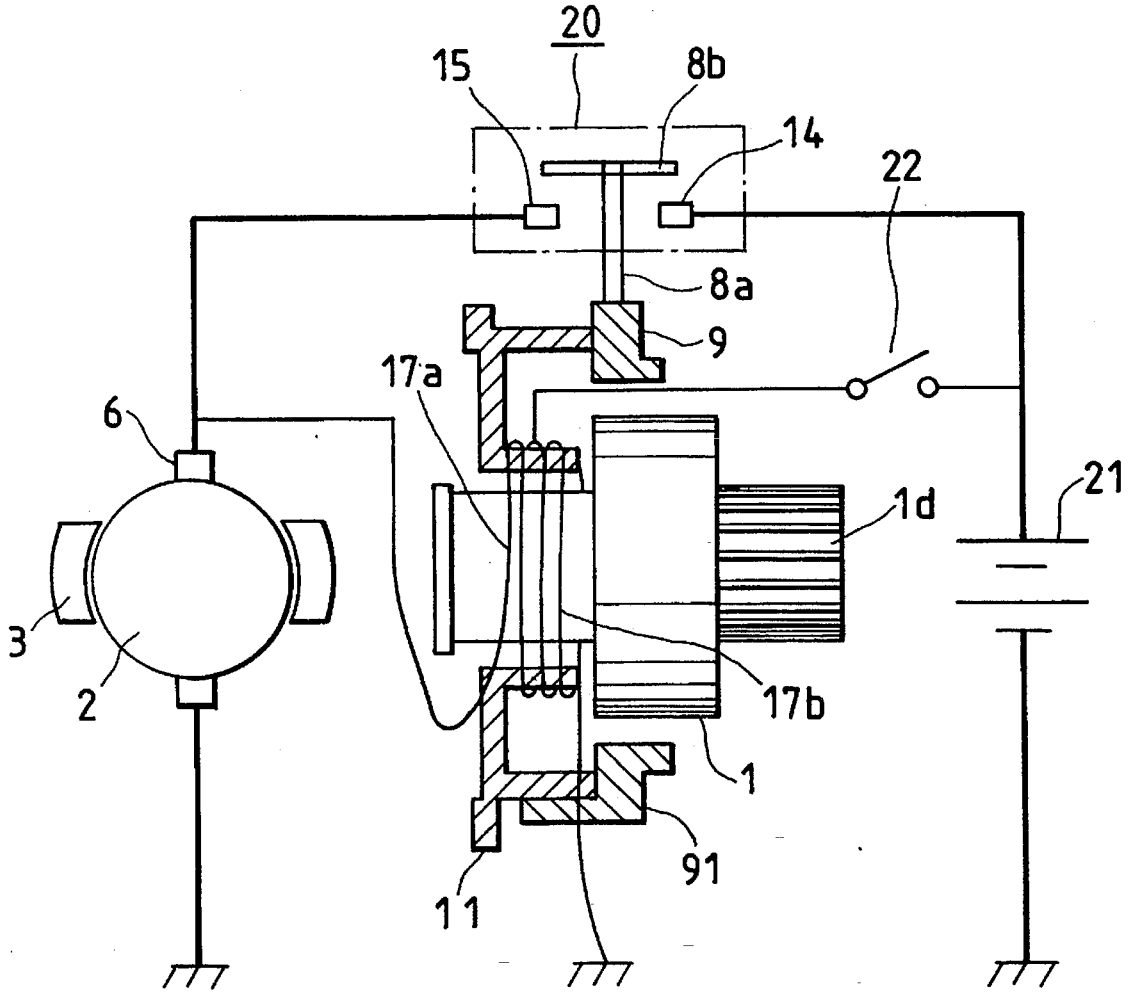
FIG. 3 is an electric circuit construction view of one embodiment of a permanent magnet starter according to the present invention.

Next, one embodiment of an electric circuit construction of the permanent magnet starter according to the present invention referring to FIG. 3.

To the above stated magnetic field coil 17 the electricity is supplied from a battery 21 through a key switch 22. The electric circuit construction is that the magnetic field coil 17 is constituted by an attracting coil 17*a* which is grounded to the earth through the brush 6 and the armature 2 and a holding coil 17*b* which is directly grounded to the earth, and the main current of the armature 2 is supplied through the main contact 20 which is opened and closed in accordance with the move of the rotation restraint member 9.

With the above stated electric circuit construction, when so as to start the engine the key switch 22 is thrown into, then the current flows to the magnetic field coil 17 (17*a*, 17*b*) and according to this magnetic field force the rotation restraint member 9 is attracted toward the pinion clutch 1 and contacts to the maximum outer periphery portion 1*b* of the pinion clutch 1.

Under the above stated condition, since the current flowing to the attracting coil 17*a* of the magnetic field coil 17 flows into the armature 2 through the brush member 6, the armature 2 starts to rotate. However, since the current flows through the attracting coil 17*a*, the large current does not flow into the armature 2, thereby the armature 2 moderately rotates.

With the above stated rotating force, it tries to rotate the pinion clutch 1, however since the rotation restraint member 9 contacts to the maximum outer periphery portion 1*b* of the pinion clutch 1, the pinion clutch 1 is slightly slipped and moves toward a side of the ring gear 18 of the engine in accordance with the function of the helical splines 2*a* and 1*a*. As a result of the above stated function, the pinion gear 1*d* of the pinion clutch 1 meshes into the ring gear 18.

Further, at a certain position arrangement between the pinion gear 1*d* of the pinion clutch 1 and the ring gear 18 of the engine, the pinion gear 1*d* moves and contacts to the ring gear 18 at the end face and as a result the axial direction move of the pinion clutch 1 is obstructed.

In the above case, according to the rotating force of the armature 2 the pinion clutch 1 rotates to the position in which the pinion gear 1*d* of the pinion clutch 1 for enabling to mesh into the ring gear 18 of the engine and finally the pinion gear 1*d* meshes into the ring gear 18.

When the pinion clutch 1 moves to the condition in which the pinion gear 1*d* of the pinion clutch 1 meshes into the ring gear 18, the rotation restraint member 9 is disengaged from the maximum outer periphery portion 1*b* of the pinion clutch 1, accordingly the engaging condition between the rotation restraint member 9 and the maximum outer periphery portion 1*b* of the pinion clutch 1 is released.

Accordingly, the rotation restraint member 9 further moves toward the central portion of the pinion clutch 1 and is positioned at a rear end portion of the maximum outer periphery portion 1*b* of the pinion clutch 1. Then the movable contact 8*b* provided on the rotation restraint member 9 is contacted to the fixing contacts 14 and 15 and thereby the electricity is supplied to the fixing contacts 14 and 15.

Figure 4:
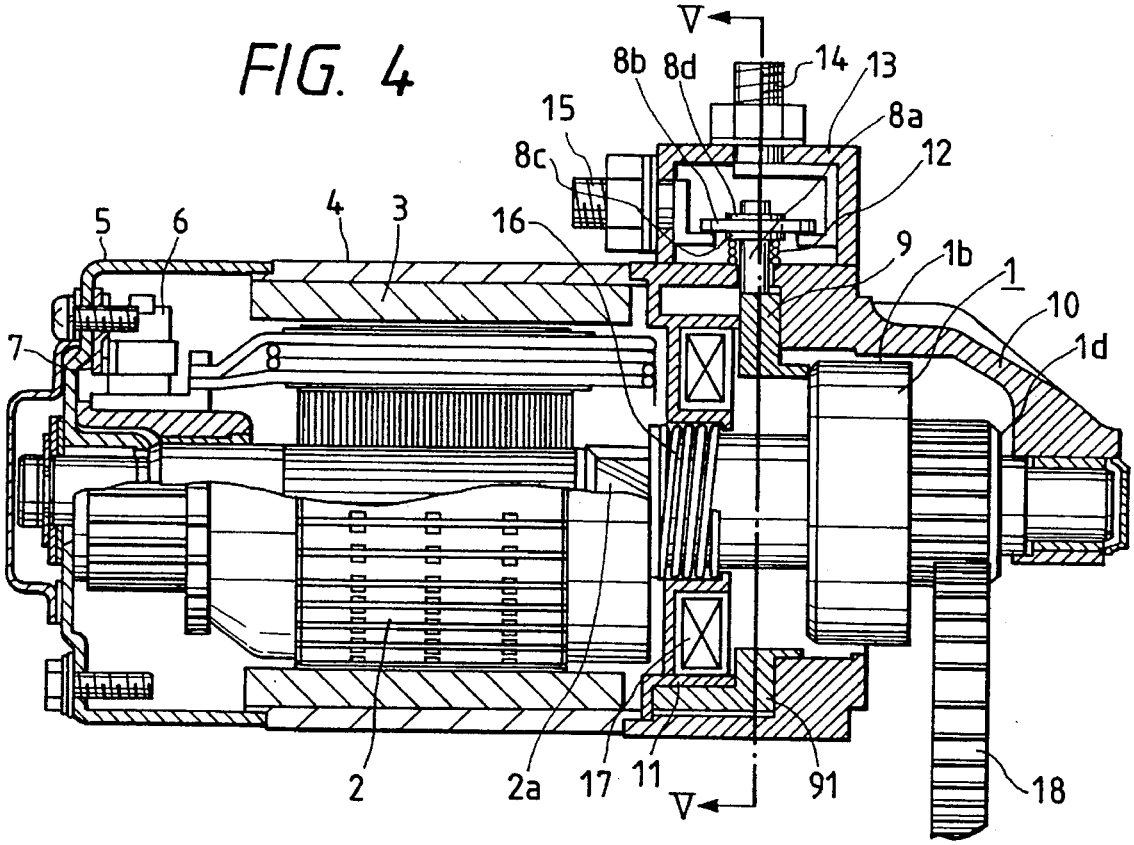
FIG. 4 is a partially cross-sectional view of one embodiment of a permanent magnet starter during the operation time according to the present invention, in which a pinion gear is meshed into a ring gear.
Figure 5:
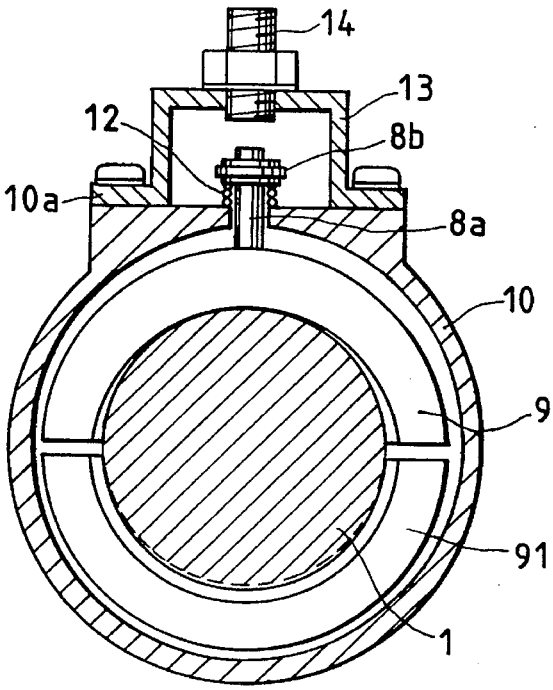
FIG. 5 is a cross-sectional view taken from a line IV—IV of FIG. 4.

Consequently, the large current flows into the armature 2 from the battery 21 and the armature 2 fully rotates. The rotating force of the armature 2 is transmitted to the ring gear 18 of the engine through the helical splines 2*a* and 1*a* and the pinion gear 1*d* of the pinion clutch 1 as shown in FIG. 4 and FIG. 5, and thereby the starting of the engine is performed.

Besides, under the overrun condition in which the pinion gear 1*d* of the pinion clutch 1 is rotated by the rotation of the engine under the unstable ignition condition of the engine during the engine starting, by the function of the helical splines 2*a* and 1*a*, the pinion clutch 1 tries to move toward the disengaging direction from the ring gear 18 of the engine.

However, as stated in the above, since the rotation restraint member 9 is positioned at the rear end portion of the maximum outer periphery portion 1*b* of the pinion clutch 1, the pinion clutch 1 unable to return, the pinion clutch 1 is not disengaged from the ring gear 18, thereby it is possible to continue to rotate the engine.

Next, after the starting of the engine, when the key switch 22 is released, since the current does not flow into the magnetic field coil 17, the attracting force against the rotation restraint member 9 is released.

Further, by the function of the contact returning spring member 12, the rotation restraint member 9 is moved toward the reverse direction against the center portion to the position in which the rotation restraint member 9 is positioned at an outer side from the maximum outer periphery portion 1*b* of the pinion clutch 1. As the same time, the main contact 20 is released and then the rotation of the armature 2 stops.

The above condition comes to present, since the move regulation of the pinion clutch 1 toward the axial direction, according to the pinion returning spring member 16 which is provided between the collar portion 1*c* of the pinion clutch 1 and the intermediate bracket 11, the pinion clutch 1 is returned toward the releasing direction from the ring gear 18, the normal condition of before the engine starting comes to present and as a result the engine stops.

According to the above stated embodiment of the present invention, even in the permanent magnet type motor having no magnetic field coil for exciting the motor, without the alteration of the motor unit, the pinion gear can move by the rotating force of the armature and the collision force during the time in which the pinion gear meshes into the ring gear can be reduced. Thereby the permanent magnet starter having the superior gear meshing withstanding property can be provided.

In the above stated embodiment of the present invention, the rotation restraint member 9 is forced by the electromagnetic force type, however it can be controlled according to the air pressure force type or the hydraulic pressure type.

Further, in the structure of the electromagnetic force type rotation restraint member, it is possible to add an auxiliary ferromagnetic member which does not contact always to the pinion clutch constructing body and then the attracting force can be enlarged.

According to the present invention, the pinion clutch is smoothly engaged with the rotating shaft of the motor through the helical spline. Further the rotation restraint member is arranged on the outer periphery portion of the pinion clutch and this rotation restraint member is forcibly arranged through the magnetic field coil which is controlled by the outside portion.

Thereby, without the lowering of the sealing property of the motor unit, the permanent magnet starter having the superior gear meshing withstanding property can be provided.

According to the present invention, since the pinion clutch is smoothly engaged with the rotating shaft of the motor through the helical spline, and further the rotation restraint member is arranged on the outer periphery portion and this rotation restraint member is forcibly arranged through the magnetic field coil which is controlled by the outside portion.

Further, since the switching means for forming the driving circuit of the motor is provided and this switching means works together with the rotation restraint member when the rotation preventing function by the rotation restraint member works, thereby the permanent magnet starter having the simplified electric circuit construction can be provided.

Further the permanent magnet starter for enable to surely obtain the rotation restraint force of the pinion gear can be provided.

We claim:

1. In a permanent magnet starter for starting an engine in which the rotating force of a permanent magnet magnetic field type electric motor is transmitted to a ring gear of said engine through a pinion clutch and a pinion gear provided on said pinion clutch, wherein, said pinion clutch is smoothly engaged with a rotating shaft of said electric motor through a helical spline and;

a rotation restraint member is arranged at an outer periphery portion of said pinion clutch to be movable by an externally controlled magnet field coil.

2. A permanent magnet starter according to claim 1, wherein said rotation restraint member is overlapped at the maximum outer periphery portion of said pinion clutch toward an axial direction to have an enough length part which is less than a move dimension of said pinion clutch.

3. A permanent magnet starter according to claim 1, wherein said magnetic field coil is formed with a cylindrical shape and is concentrically arranged and fixed to said rotating shaft of said electric motor.

4. A permanent magnet starter according to claim 1, wherein a pair of said rotation restraint members is formed with a semi-cylindrical shape and each of said pair of said rotation restraint members is concentrically and oppositely arranged through said pinion clutch.

5. In a permanent magnet starter for starting an engine in which the rotation force of a permanent magnet magnetic field type electric motor is transmitted to a ring gear of said engine through a pinion clutch and a pinion gear provided on said pinion clutch, wherein, said pinion clutch is smoothly engaged with a rotating shaft of said electric motor through a helical spline;

a rotation restraint member is arranged at an outer periphery portion of said pinion clutch to be movable by an externally controlled magnet field coil; and switching means cooperating with said rotation restraint member, and forming a driving circuit of said electric motor.

6. A permanent magnet starter according to claim 5, wherein a pair of said rotation restraint members is formed with a pair of semi-cylindrical shape and each of said pair of said rotation restraint members is concentrically and oppositely arranged through said pinion clutch; and to one of said pair of said rotation restraint members, a movable contact of a switching means for forming a driving circuit of said electric motor is provided to operate together with said rotation restraint member.

7. A permanent magnet starter according to claim 6, wherein said magnetic field coil is formed with a cylindrical shape and is concentrically and oppositely arranged against said rotating shaft of said electric motor; and said magnetic field coil comprises a holding coil which is connected to a power supply and the earth through a key switch, and an attracting coil which is connected to a power supply and said electric motor through said key switch.

* * * * *